US006065417A

United States Patent [19]

Vuckovic

[11] Patent Number: 6,065,417

[45] Date of Patent: May 23, 2000

[54] SHIP

[76] Inventor: Milos Vuckovic, Orszaghaz u. 6, H-1014 Budapest, Hungary

[21] Appl. No.: 09/078,854

[22] Filed: May 14, 1998

[30] Foreign Application Priority Data

May 15, 1997 [DE] Germany ..... 297 08 627 U
Jun. 12, 1997 [DE] Germany ..... 297 10 209 U

[51] Int. Cl.[7] ..... B63B 9/08

[52] U.S. Cl. ..... 114/121; 114/126; 114/144 R; 114/162

[58] Field of Search ..... 114/121, 61, 122, 114/127, 124, 125, 126, 271, 144 R, 162

[56] References Cited

U.S. PATENT DOCUMENTS

| | | | |
|---|---|---|---|
| 2,210,935 | 8/1940 | Giliberty | 114/126 |
| 3,842,777 | 10/1974 | Larsh | 114/126 |
| 5,511,504 | 4/1996 | Martin | 114/61 |

*Primary Examiner*—Stephen Avila
*Attorney, Agent, or Firm*—Friedrich Kueffner

[57] ABSTRACT

The hull (100) of a ship with an elevated steering stand (200) is provided with a device for the leveling compensation of hull motions which, in at least one plane, compensates a hull movement in the pitching direction, in the rolling direction and in the vertical direction.

19 Claims, 9 Drawing Sheets

Fig.11
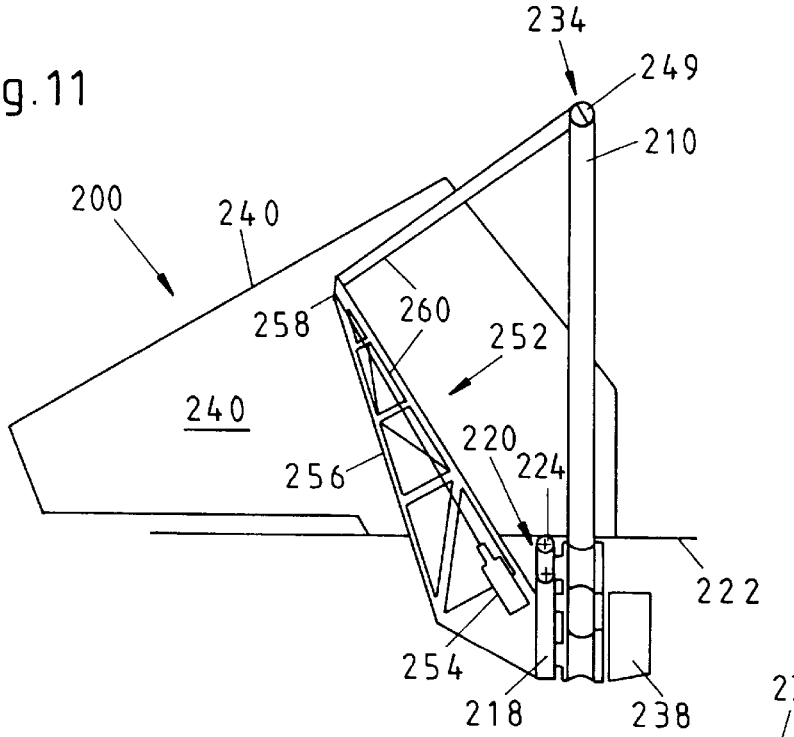
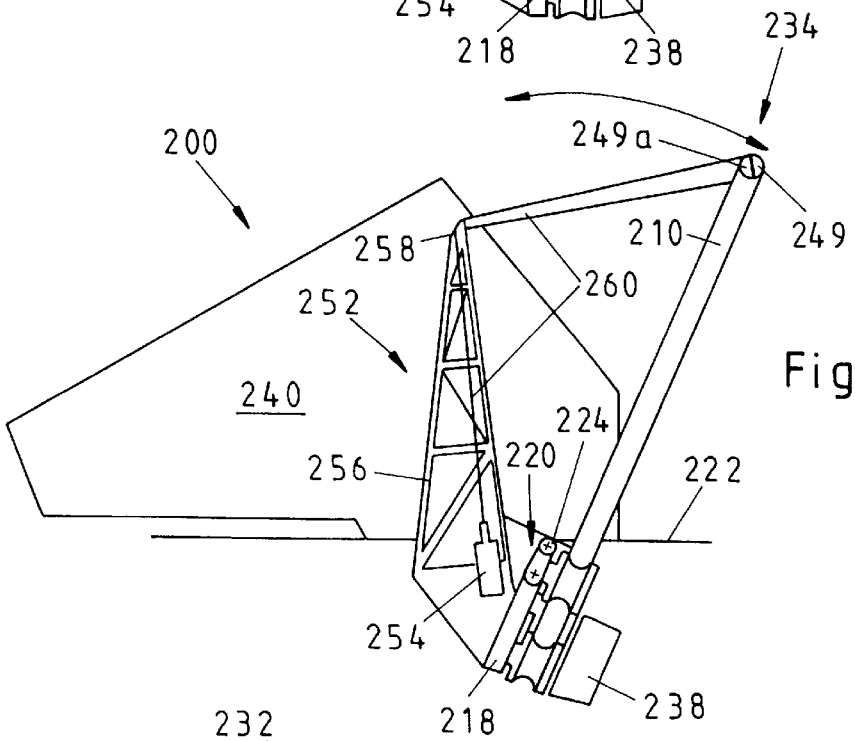
Fig.12
Fig.13
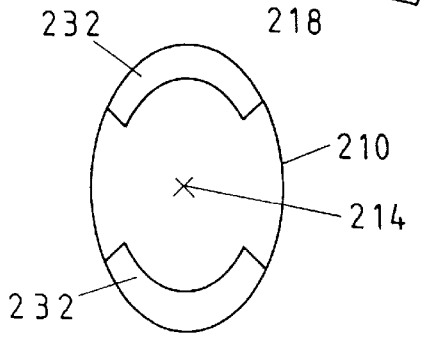

SHIP

BACKGROUND OF THE INVENTION

1. Field of the Invention

The invention relates to a ship wherein the hull possesses an elevated steering stand.

2. Description of the Related Art

A floating body, such as e.g. a ship's hull that is only stabilized by its center of gravity, is exposed to the influences of the water and the wind and, according to the wave motions, a rolling and/or pitching movement as well as a vertical movement or a combination of these is forced upon the ship.

The expression rolling axis designates herein the longitudinal axis of the hull and, by rolling movement, a tilting of the hull about the longitudinal axis is designated. The expression pitching axis designates herein the transverse axis of the hull and, by pitching movement, a tilting of the hull about this transverse axis is designated.

Such motions are often perceived as unpleasant and frequently lead to seasickness and, in addition, jeopardize the ship since strong deflections of the hull about the rolling and/or pitching axis can result in a slipping out of position of the cargo and, if the worst comes to the worst, in the capsizing of the ship.

In conventional steering stands, the steering or hand wheel is mounted on a steering pedestal or column and, with the aid of mechanical or electronic devices, acts upon the rudder blade of a ship. However, these systems are subject to disadvantages inasmuch a helmsman in a sitting position is only able to operate the steering wheel inadequately or not at all and, moreover, has a poor view of the navigation or other instruments, which are disposed behind the steering wheel so as to be partly covered by the latter and the steering pedestal. Furthermore, the steering pedestal enforces a relatively great distance between a sitting helmsman and the trick wheel since the former has to rest his legs between himself and the steering pedestal. That is why the helmsman is compelled to assume a standing position in order to ensure a safe operation of the steering wheel.

SUMMARY OF THE INVENTION

It is the technical problem of the present invention to make available a ship with an improved hull and with a steering wheel of the above-stated type, which eliminates the aforementioned disadvantages.

The technical problem is resolved by a hull of the above-stated type that is provided with a means for the leveling compensation of hull motions which, in at least one plane, compensates a hull movement in the pitching direction, in the rolling direction and in the vertical direction.

For this provision is made according to the invention that a means for the levelling compensation of hull motions is provided, which, at least in one plane, compensates a hull movement in the direction of pitch, direction of rolling and in the vertical direction.

This offers the advantage that the travel of the ship through the water proceeds in greater safety and is more pleasant for passengers and crew.

In the steering stand provided in this ship, guiding means are provided which support the steering wheel, on its circumference, rotatably about a center axis.

This has the advantage that the steering wheel is in no way supported on a steering pedestal so that the same can be dispensed with altogether. The spokes provided in the known steering wheels are likewise dispensed with.

Due to the circumstance that the steering wheel is substantially constructed in the form of a circular hoop, a large, unhampered passage area is obtained so that the helmsman or wheelsman is able to operate the steering wheel also in a sitting position and, while assuming this sitting position, the legs of the helmsman, by way of example, can be passed, or grip with their thighs, through the cross section of the steering wheel and pedals mounted within the rear region of the steering wheel can be operated.

A particularly simple and effective arrangement results when the guiding means possesses rollers which are disposed on both sides of the steering wheel in such a way that the steering wheel, on its circumference, is rotatably supported about its center axis.

For a flexible positioning of the steering wheel that is adaptable to the requirements of the helmsman, the guiding measns is provided with a frame which is rotatably mounted in such a way that the guiding means can be swiveled about a swivel axis together with the steering wheel. In this case, the swivel axis is preferably formed substantially along a bottom or floor area of the steering pedestal and, more particularly, vertically to the axis of rotation of the steering wheel.

In this case the frame is expediently supported laterally on two pivoting points on a floor of the steering stand.

The helmsman receives data and information necessary for and important to him by preference with the aid of a display means provided on the steering wheel.

For an especially simple and direct readability, the display means is disposed on the circumference of the steering wheel and substantially following the same and aligned in the direction of an operator.

In a particularly preferred embodiment, the display means possesses a projector and a video screen or a display, in which case the screen is disposed on the circumference of the steering wheel and the projector is disposed on the guiding means spaced away from the screen. This offers the advantage that the date is at all times projectable by the projector on to a predetermined position on the circumferential area of the steering wheel independently of the position or the rotation of the steering wheel, by way of example, in a 12 o'clock position, i.e. when seen from the helmsman, on the top zenith of the circumferential area of the steering wheel.

For guiding the projector e.g. outside a foot area in order to avoid any shading of the projector, the projection path is preferably guided via a path-folding mirror.

For a at-all-times good readability of the date projected on to the steering wheel independently of the position or rotation of the steering wheel, the entire circumference of the steering wheel is constructed in the form of a screen.

For the representation of further important data in a clear manner, which can be read without the helmsman or the steering wheel having to undergo a change in position, a monitor is disposed on the side of the steering wheel which faces away from the operator.

For further operational function, which can be operated by the helmsman without any positional changes with regard to the steering wheel, pedals are disposed on a side of the steering wheel that faces away from the operator.

By virtue of the hull construction, a particularly good leveling of the ship against wave motion results with the possibility of raising the ship in its entirety or merely at the bow or the stern in that the means for the leveling compensation, in a first leveling plane, comprises trimming rudders mounted on the bow side and/or on the stern side on the hull underside. In this case the trimming rudders are preferably swivelable along a line relative to the hull, with this swiveling line proceeding at a predetermined angle to the longitudinal axis.

For a maximum effect, the swivel axes of two oppositely located trimming rudders, one of which is mounted on the port side and the other one on the starboard side, run, when regarded in the direction of travel, apart in divergent directions and are preferably in each case disposed adjacent to a breakaway of the flow on the underside of the hull, more particularly in each case upstream of a breakaway of the flow.

Substantially enhanced steering properties and a simple handling of the ship's steering are achieved due to the trimming rudders being steerably connected with the ship's rudder, in which case the swivel angle of the trimming rudders relative to the hull is controllable by pressing and pulling the ship's rudder analogous to the control column of an airplane.

An automated leveling is achieved in that control electronics with a level sensor are provided, which adjust and extend the azimuth angle of the trimming rudders in such a way automatically that the hull is leveled in relation to motions caused by sea disturbance.

For a further increased effectiveness of the leveling relative to the steering stand, the means for the leveling compensation comprises in a second plane a movable mounting or support of the steering stand on the hull, particularly on a connecting turret on the hull, in which case the steering stand, in relation to the hull in the direction of pitch, direction of rolling and in the vertical direction, is movably supported.

By preference, the movable mounting or support of the steering stand is effected by hydraulic means, in which case the same comprises two, more particularly, three hydraulic elements.

For an automated leveling in an especially preferred manner, control electronics with level sensor are provided, which trigger the movable support of the steering stand in such a way that the same is leveled relative to the hull motions due to e.g. sea disturbance.

For enabling a simple and safe entering of the steering stand also during the leveling, a crosswalk or walkway with a longitudinal compensation means is provided.

For a further improved effect of the leveling, the means for the leveling compensation comprises in a third plane a connecting turret between hull and steering stand, in which case the connecting turret is movably mounted on the hull in the direction of pitch, the direction of rolling and in the vertical direction.

The movable support of the connecting turret is preferably effected by hydraulic means and comprises at least one filling piston-like element. It is also conceivable to solve the problem of the correct position of the turret and of the helmsman's cabin solely mechanically in that a center of gravity support at the foot of the turret and on the connection of the cabin is provided and solely overdimensional impacts are absorbed with the aid of a damping means.

For an automated leveling, an electronic control means with level sensor is provided in a particularly preferred manner in such a way that the steering stand on the connecting turret is leveled against the movement of the hull that is e.g. caused by rough seas.

For a simple and safe passage of a person into the steering stand, between the hull and the connecting turret and/or between the connecting turret and the steering stand, crosswalks with longitudinal compensation means are provided.

A particularly comfortable steering stand is produced by the same being constructed in the form of a pilot's cockpit.

An especially stable hull is obtained in that at least a predetermined section of a hull wall, in cross section, possesses an S-configured profile.

On the stern of the hull, a landing stage with gangway laterally rotatable relative to the hull is provided, in which case, in the inwardly-turned state, the landing stage forms a railing of the ship's wall.

In a particularly preferred manner, the hull widens in the form of an arrow from the bow in the direction toward the stern and tapers significantly within a midship deck area. In this case the tapering in the midship deck region is preferably constructed in the above-water hull only.

Expediently, provision is made for a ship's boat lifting system integrated into the hull. It is also possible to compensate inclinations/pitches caused by the operation of this system by means of the system according to the invention.

For a direct propulsion with particularly good maneuvering properties, on the underside of the hull within the midship area and on the stern, preferably one bow thruster each is provided. In order to further improve the response behavior of these bow thrusters also at slow speed, the bow thrusters are additionally provided with retractable center-board rudders.

BRIEF DESCRIPTION OF THE DRAWINGS

In the following, the invention is explained in greater detail with the aid of the attached drawings. Thus

FIG. 11 shows a steering stand in a further side view in an upright position;

FIG. 12 shows a steering stand in a further side view in a swiveled position;

FIG. 13 shows a top view on to a steering wheel according to a further embodiment.

DETAILED DESCRIPTION OF THE PREFERRED EMBODIMENT

Figure 1:
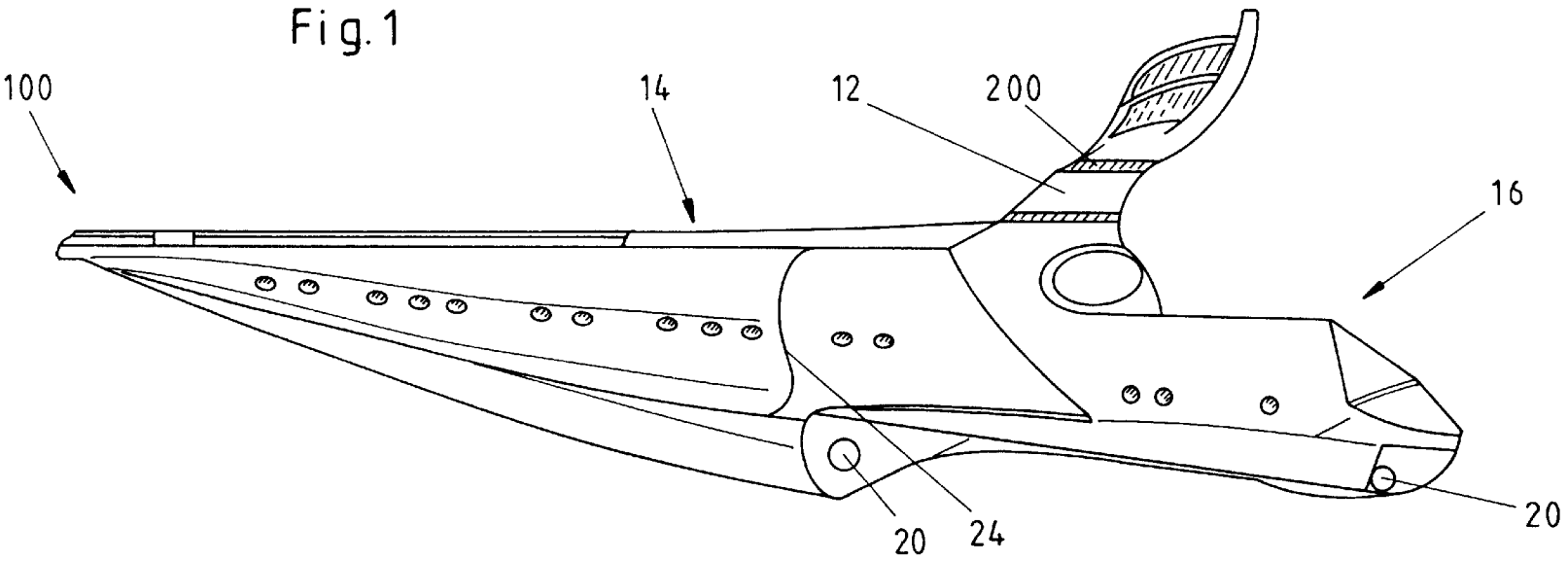
FIG. 1 shows a side view of a preferred embodiment of a ship's hull.
Figure 2:
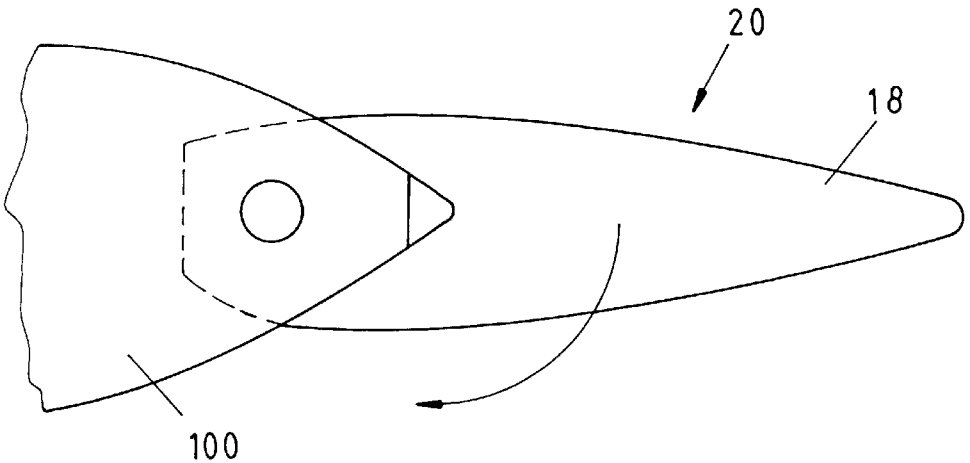
FIG. 2 shows an enlarged representation of a bow thruster with a center-board rudder.

The FIG. 1 shows a side view of a hull 100 with a steering stand 200, which is disposed in an elevated manner on a connecting turret 12. On an underside of the hull 100, bow thrusters 20 are constructed once within the midship region 14 and once on the stern 16. As is discernible from FIG. 2, the bow thrusters 20 are additionally equipped with sword-type rudders 18 that are swivelable or retractable in the direction of arrow 22. As can be gathered further from FIG. 1, the hull is provided with S-configured lateral bulges 24.

The movable and level-regulated cockpit 10 can be realized in the most widely varying ways. According to the invention, a preferably automated list compensation of the hull is effected which is caused by inclined positions due to wave action or pitching motions of the hull. The cockpit is in this case tiltable about a rolling and a pitching axis and, in addition, displaceable in the vertical. Analogous drives are known e.g. from the area of platforms for flight or vehicle simulations, in which case, however, in contrast with these applications, it is not intended to simulate any movements, but the intention is to counteract a movement of the hull.

By means of a specific height of the cockpit, an adequate working area for all directions of movement, especially for the vertical travel relative to the hull is ensured.

With relatively small movements, by way of example at the attachment low end of a connecting turret between the cockpit and the hull, by means of the lever effect, an intensified effect on the cockpit is achieved. However, a pertinent effect becomes possible also without connecting turret, that is to say when the cockpit is mounted on the hull direct, which is hereby supported on the deck. In this case it is not of material importance how the cockpit is secured, but what does matter is that the same is movably mounted in three spatial axes (in addition to the two axes of the turret, thus five axes) so that the pilot of the ship draws a moderated, if not even "straight" "flight path" above_the hull affected by wave action and by wind, in which connection this straight path is equally realized in three axes.

However, the following prior conditions and safety problems have to be taken into consideration in the detailed construction of the mobile support: It must at all times be possible to reach and to leave the cockpit 10 or the steering stand 200. The cockpit 10 should be connected with the internal area. It should possess an emergency exit. In the event of a failure of the generation unit, all functions of a normal seaworthy ship must be preserved. It should possess a perfect air conditioning and ventilation system. All instruments for an optimal operation of the ship must be available. If a suspension were to fracture, the navigability must continue to be ensured. The total weight of the system must be located within an uncritical region of the ship.

The cockpit 10 is able to compensate heelings and accelerations in the transverse axis or axis of pitch of up to approximately 20°, to compensate in the longitudinal axis or rolling axis by approximately 25° and to be raised and lowered by approximately 2–3 meters. This is accomplished by two large hydraulic cylinders, which are mounted so as to be tiltable in the longitudinal axis. The cylinders are retained in position by two parallelly operating hydraulic units. The tilting motions of the cockpit 10 are regulated by a further hydraulic unit, which operates at the mounting point of the two cylinders on the suspension of the cabin. If a loss of pressure occurs, the cabin is lowered on to a kinematically stable pedestal on the turret point and can be arrested by means of stored emergency pressure.

The turret 12, in its capacity of retainer of the cockpit 10, accommodates e.g. a variable stairway contiguous to the cockpit, stair elements and one or more compensation gangplank(s) in order to ensure a perfect passage when the cockpit 10 and the turret 12 are raised or swiveled. In this case the turret 12 is, by way of example, carried by three hydraulic elements and consequently forms part of the "steadied" or "compensated" area which, with increasing height in the direction of the cockpit 10, is improved and, in the ideal case, comes to rest completely at the cockpit 10. The turret 12 has the task of compensating lists of up to approximately 25° to each side. It is moreover capable of compensating inclinations in the longitudinal axis of the ship 100 of up to 15° in the forward direction and in the rear likewise of up to 15°. It is also capable of braking any pitching caused by arriving waves and of compensating accelerations, e.g. into the wave trough.

The transition from the stationary cargo hold into the compensated turret 12 or into the compensated cockpit 10 is achieved with the aid of a spot-supported movable bridge into the metacentric plane of the three acting hydraulic units in the base of the turret 12. From here onward the way leads e.g. approximately one meter via five steps that are connected with the turret, upwardly in the direction of the cockpit 10 to a lift compensation walkway that rests on one side on the turret and which, on the other side, is led by a following cockpit stairway. When elevating movements are executed, the walkway compensates between the two heights. On account of the length of approximately 3.5 meters and receding rest position, it is capable of coping with differences of up to 2 m. The stairway preceding it to the cockpit 10 is attached freely suspended on the cockpit and possesses a further circular walkway as a link in the form of termination. Auxiliary guideways proceed downwardly to the two hydraulic cylinders.

Figure 3:
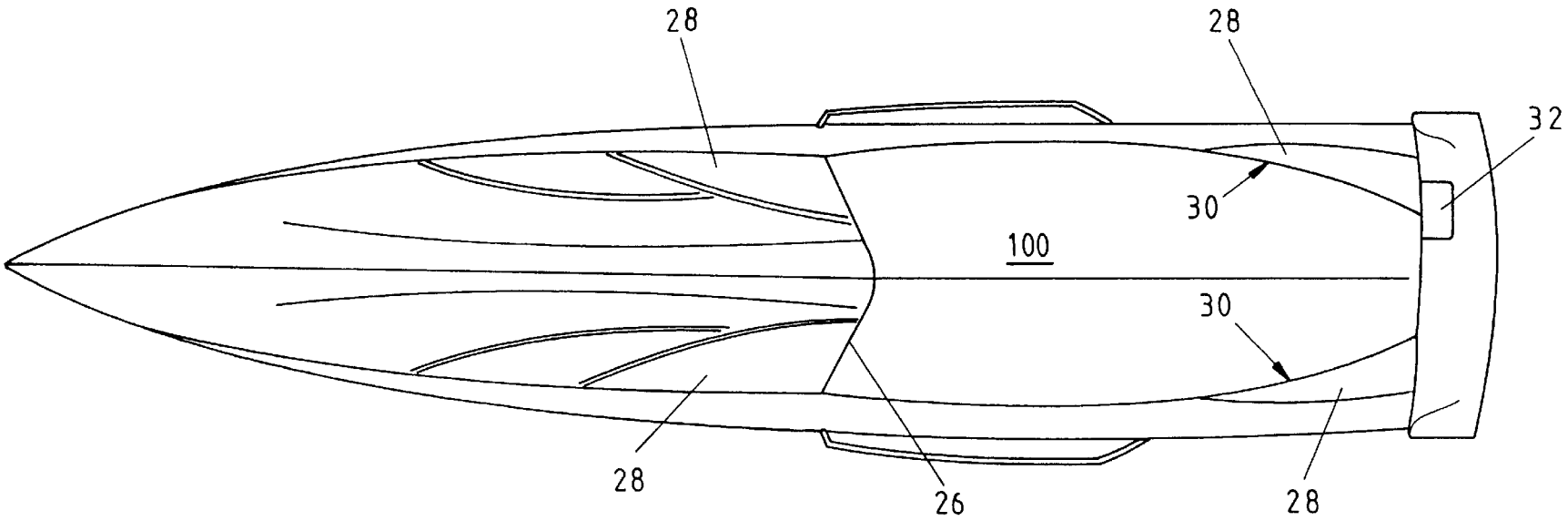
FIG. 3 shows a hull in a view from below.

A breakaway of the flow 26 is discernible from FIG. 3, in the center of the ship 100, represents a sensitized point which carries more than the following hull area of the ship's weight and modifications within this area have a considerable influence on the navigational behavior of the ship. It is for this reason that, within the immediate proximity, diagonally proceeding trimming rudders or flaps 28 are mounted which diverge in opposite directions in their angle of forward travel. The diagonal attachment lines are designated with 30. In an extending or outward traveling activity, they change the existing fixed hull angle of approximately 35° variably into a more obtuse angle. The consequence thereof is an immediate emergence of the entire front portion of the ship. On the other hand, by the retraction of the flaps it is possible to lower the prow of the vessel again.

On the stern breakaway of flow 32 of the hull 100 similar flaps are fitted, whereby an interesting interplay results. The ship can, to a certain extent and in dependence of the size of the flaps and the speed of travel, be influenced in all axes, such as the rolling, pitching and the vertical axes.

The elevation of the bow, with extended center flaps 28 and retracted stern flaps 28, amounts to approximately 3 to 4 m relative to the opposite position of the two pairs of flaps. Waves can be ridden out in this manner. The influencing of the transverse axis when the flaps are actuated sideways is likewise highly effective. Due to the heaviness of the after quarter and the greater width of the position of the stern flaps 28 relative to each other, a larger lateral degree of inclination does result in the rear flaps 28.

The character of this hull when the flaps 28 are extended corresponds to a so-called three-point slide with ascending angles. The further the flaps are extended, the more the ship floats up and reduces the wetted water surface.

With suitable control software, a computer control and a level sensor, this equipment constitutes a considerable improvement of the seagoing performance and comfort of a ship.

The S-shaped continuation of the lines of the two breakaways of flow 26 and 32 results in a significant improvement in the seaworthiness. At slow travel they serve as dampers against the feared rolling or listing since they act in the form of a longitudinal keel.

The function of the diagonal flaps can be integrated into the pulling and pushing movement of a steering wheel. However, it is also possible for gas functions, or, when in port, for forward/backward functions to be put on or also further functions or combinations thereof.

The S-configured lateral design (cf. FIG. 1) constitutes an improvement in the static rigidity.

Figure 4:
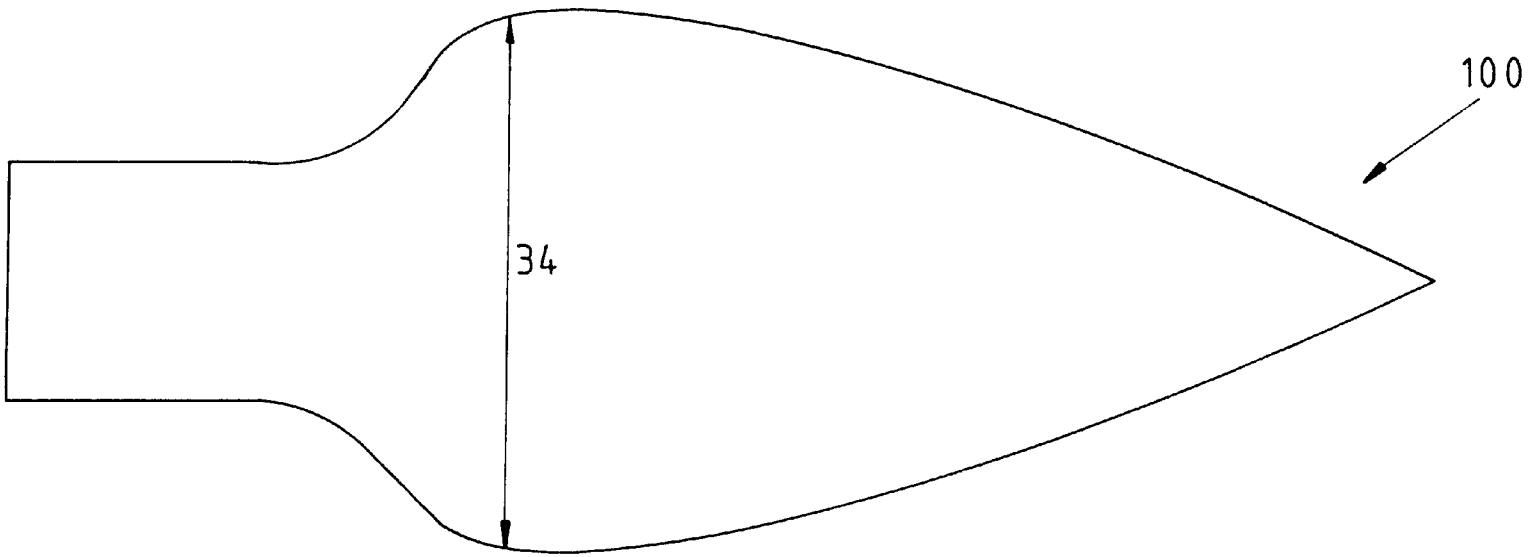
FIG. 4 shows a hull in a longitudinal section.

The "arrow construction", as can be gathered from FIG. 4, is a widening of the midship deck area 34 with an invariable hull.

A hoisting system of a tender serves as a padded safe small harbor entrance on the hull 100. The tender travels unimpededly into the opening, where it is, e.g. with the aid of a remote control, by means of a net located in the underwater area which is equipped with special rollers that are weighted internally and keep the net low in the water, quickly raised on two lifting tracks and arms into a safe area.

Figure 7:
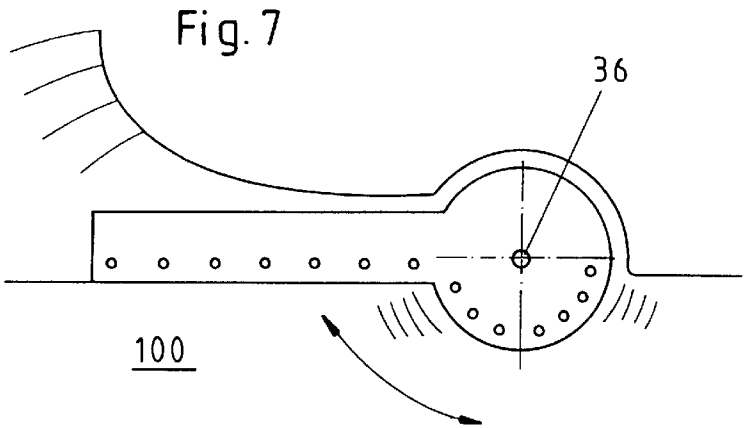
FIG. 7 shows a hull in a view from the top with landing stage.
Figure 6:
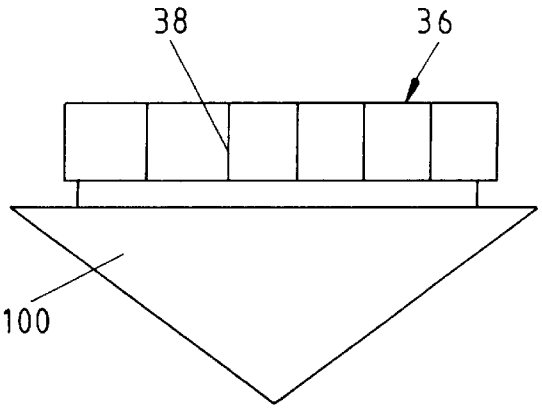
FIG. 6 shows a hull in a rear view on to the stern with landing stage.

From the FIGS. 6 and 7, a landing stage 36 with several functions can be seen. It serves as termination of a stern (FIG. 6) and is rotatable, in which case the terminal railing 38 constitutes a safe and sturdy hand rail. By way of example, on the side of a curve, a bathing stairway is to be found. The longitudinal side and the railing can be extended further in the extended state.

Figure 5:
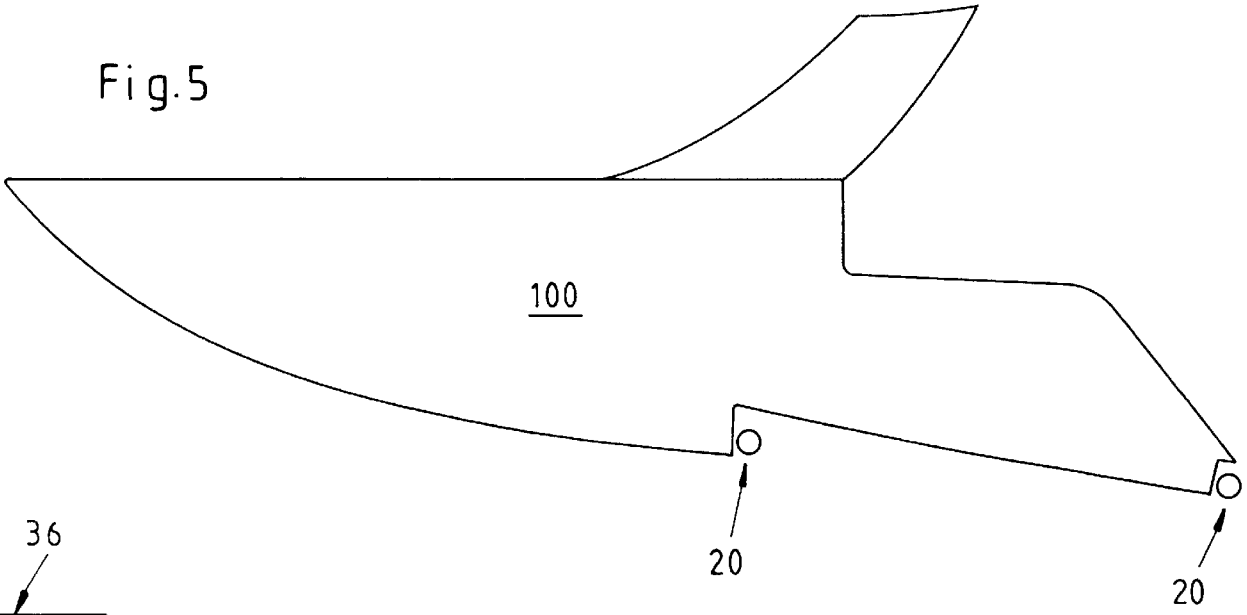
FIG. 5 shows a hull in a lateral cross section.

It is known that, in slow travel, water-jet propulsion does not possess good rudder and maneuvering properties. That is why, on the bow thrusters (FIGS. 1 and 5), retractable sword-type rudder blades are provided laterally on the movable jets so as to, by way of example, bring about an improved directional behavior in heavy seas.

Since both the engine beds as well as the overall construction of the cockpit and stairs are constructed in a swinging manner, a smaller strain on the ship structures results from blows by the sea and in rough seas. When using the cockpit 10 according to the invention, the unpleasant seasickness is alleviated. The efficiency of a ship's crew is incomparably greater in such comfort.

For a better understanding, in the following, the sequence of riding out an occurring wave is described once more in context.

The wave coming from the front or from the side lifts the ship. At a time at which the wave cannot as yet be perceived by the passengers, the computer tries with the aid of a level sensor and the pertinent software, to readjust the lifting of the ship by lowering the front trimming flaps 28 and by raising the stern flaps 28. This is the first operating or compensating plane.

The second operating or compensating plane is the connecting turret from the hull 100 to the cockpit 10, which It is of course capable of distinguishing between a pitch caused by waves and a desirable tilt resulting from the steering adjustment and the relation to the speed, for example, the "leaning into the curve". In this case the driver is always in balance, thus vertically to the axis of acceleration as, by the way, also when starting and braking.

If the ship encounters a wave in a cornering travel, pitching priorities are set and the adjustments most pleasant for crew and owner are given preference.

Starting with a certain time (wind, waves or other extreme hazards) or at a certain speed, individual stages of the system, or also all the components, are switched off and brought into the stable rest position.

It is also possible to manually adjust or operate subareas. As an example, the quattro trim steering dependent upon the steering angle has to be mentioned in this case, which, when the guide rod is pulled, extends the front flaps and retracts the rear flaps. With this one rides out a wave in the true sense of the word. The raising of the bow resulting from the opened flaps 28 in the front and the closed flaps 28 in the rear, amounts, depending on the speed of travel, up to approximately 3 to 4 meters. A more comfortable riding out of the wave even in extreme storms and a reduced immersion in wave troughs constitutes a substantial advantage. If one also adds the gas operation and the trimming flaps to the position of the steering angle, one obtains greatly improved controls of the ship. The traveling sensation should be identical with that of a big surfboard. is laterally hydraulically swivelable through up to 25° and in the forward and backward directions through 15°.

The third operating or compensating plane is located in the cockpit 10 itself. For safety's sake, the same is equipped with two hydraulic units possessing a travel path of 2 m each. In the longitudinal direction it can be swiveled through approximately 25°.

The fourth operating or compensating plane is in the lateral inclination of the cockpit. In this case, with the aid of two smaller hydraulic cylinders, the cockpit is inclined on both sides by 20°.

It is possible of course to also simultaneously respond to all the axes, the pitching, rolling and vertical axes in a combined operation.

In the stand-by position, the cockpit 10 is preferably at a height of 2 m or more. This ensures that all the motions can be cushioned at this height. The cushioning work is dealt with with the aid of a pressure-yielding unit. It regulates the smaller shocks. In other words, the regulating software turns the hydraulic cylinders into an intelligent spring-shock absorber unit, which compensates the pitch occurring at every undesirable movement in a highly efficient manner.

Since the software involved is e.g. a self-learning and correcting unit, it distinguishes between full loading, wrong loading, changing loads and other negative influences on the ship's position. This is done by the computer, which, in the theoretical/actual comparison to the level sensor, takes the immersion time, length and duration of the rolling and pitching motions and the divergences as well into account.

Figure 8:
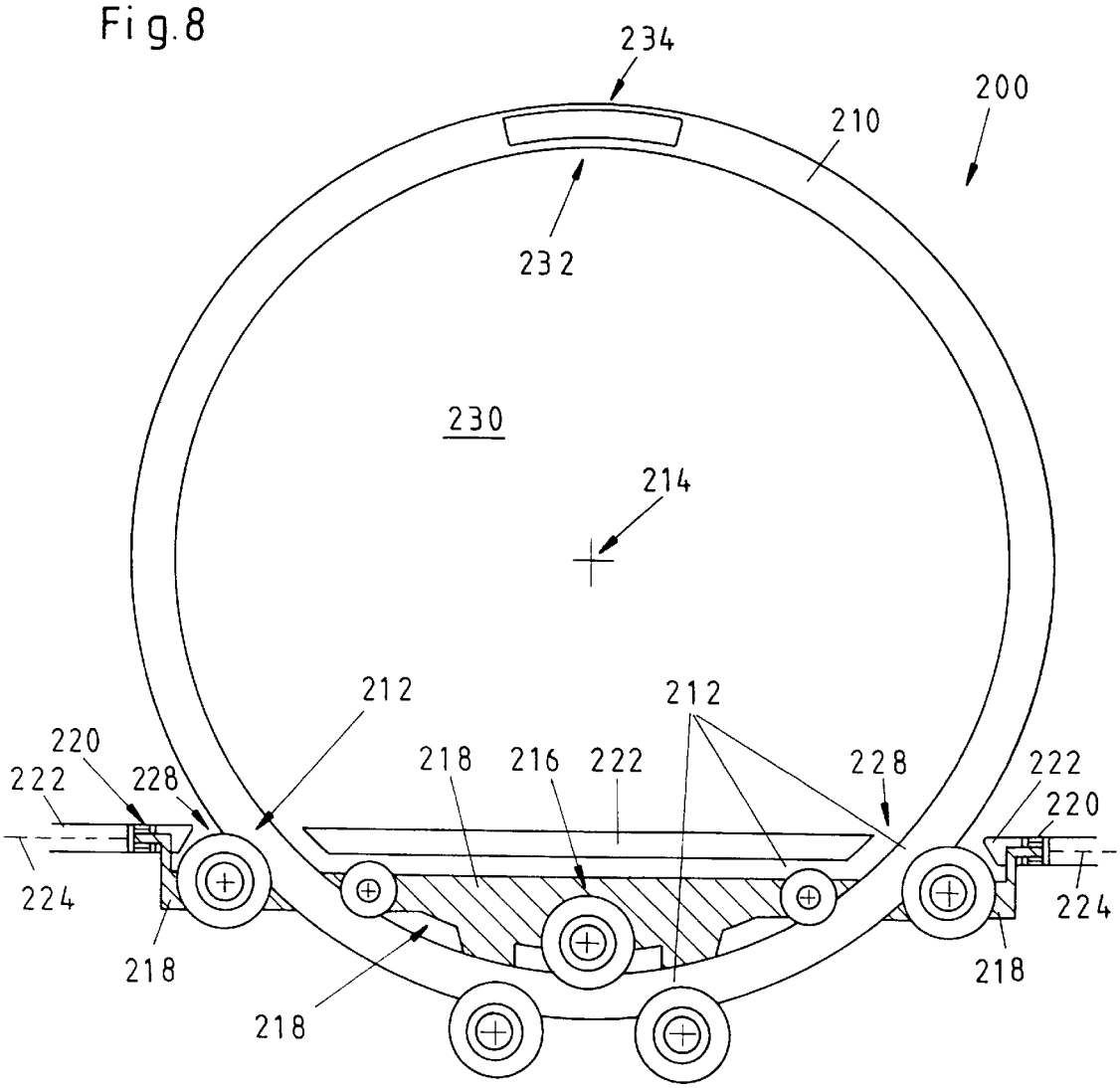
FIG. 8 shows a steering stand in a top view.
Figure 9:
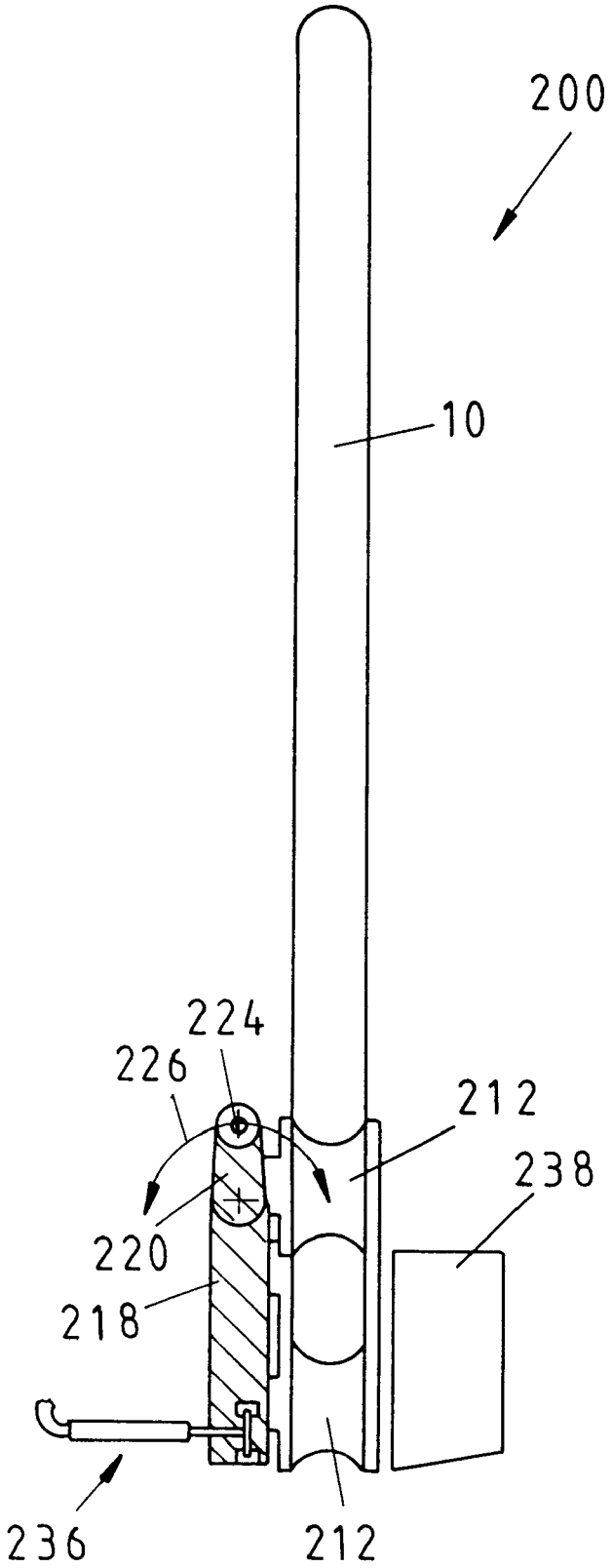
FIG. 9 shows a steering stand in a side view.

The steering stand 200 illustrated in FIGS. 8 and 9 comprises a steering wheel 210 which is supported in guide rollers 212 so as to be rotatable about a center axis 214. In addition, for the absorption of the rotating movement of the steering wheel 210 and the corresponding transmission of this movement to a non-depicted rudder, a transmission roller 216 is provided. All rollers 212 and 214 are mounted on a frame 218 which, via suspension means 220 with bearings, is supported on a floor 222 of the steering stand 200 so as to be rotatble about an axis 224. This is accordingly indicated in FIG. 9 with an arrow 226. The suspension means 220 with bearings form movably adjustable anchorage supporting points for swiveling the steering wheel 210 about the axis 224.

By way of example, the frame 218 is a rocker-type guide rod frame and the steering wheel 210 is passed through apertures 228 in the floor 222. The steering wheel 210 possesses the configuration of a hoop or of a ring and is mounted solely on its circumference by means of rollers 212. An empty open area 230 surrounded by the steering wheel is created thereby, through which a helmsman, when operating the steering wheel 210 in a sitting position, is able to stretch his legs without thereby restricting the movability or rotatability of the steering wheel. Due to the support of the steering wheel 210 on its circumference, the necessity of a steering column or pedestal and associated steering wheel spokes is dispensed with. In lieu thereof, the steering wheel 210 is freely rotatable endlessly in all directions.

The steering wheel is supported openly as it were and this with the aid of the guide rollers 212, which are fitted in the bottom area 222 so that, in principle, the steering wheel 210 is comprised of a ring which is retained and guided via the guide rollers 212 at the bottom. The guide rollers 212 possess a retaining function for the steering wheel 210; they can also be employed as transmitting means. In such a case the guide rollers are provided with gear rings that engage into corresponding elements, such as e.g. toothed rims or toothed racks on the steering wheel 210 in order to actuate the same via a control unit.

On the circumference of the steering wheel 210, within a predetermined area, at least one display 232 is mounted, which either moves along with the steering wheel 210 or, by means of a projection technique to be described in greater detail hereinafter, represents data always at a predetermined position on the circumference of the steering wheel 210. This fixed position is, by way of example, as depicted in FIG. 8, the 12 o'clock position 234 of the steering wheel circumference or, in other words, the upper zenith of the steering wheel circumference.

For supporting or executing the tilting operation about the axis 224, as becomes apparent from FIG. 9, a transmitting cylinder 236 is mounted on the frame 218 for the tilting function, in which case a counterweight 238 stabilizes the tilting movement. It is also possible for the transmitting cylinder 236 to possess the function of a damper.

Figure 10:
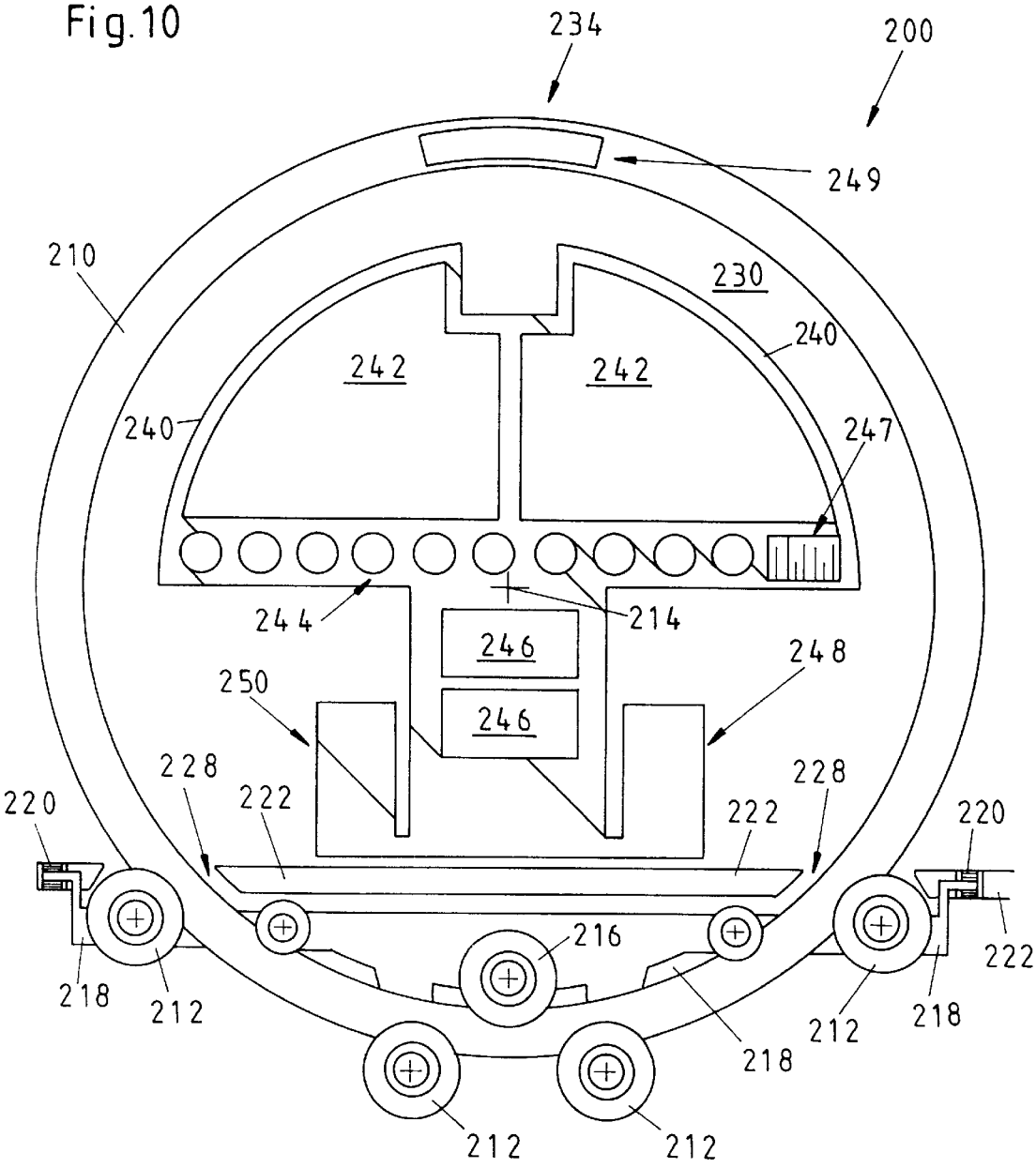
FIG. 10 shows a steering stand in a further top view with additional instruments.

The free passage area 230 of the steering wheel 210 can, for instance, be utilized that, seen from the helmsman, additional displays and instruments are disposed behind this area, as illustrated in FIG. 10. These are, by way of example, a monitor 240 with projection displays 242, emergency instruments 244, further monitors 246, an alarm indicator 247, a display of a steering wheel projector 249 and right-hand and left-hand pedals 248 and 250.

The helmsman is consequently seated within the circumference of the steering wheel 210 and has a simultaneous view of all the aforementioned instruments 240 through 250, while, with the aid of his legs passed through the opening 230, he is able to operate the pedals 248 and 250 at the same time.

The FIGS. 11 and 12 depict two different swivel positions of the steering wheel 210 about the axis 224, while the monitor 240 remains immovably in his position. Furthermore, a projection means 252 is discernible which swivels along. This comprises a projector 254, which is secured in a cantilever 256 on the frame 218. One end of the cantilever 256 is secured to the frame 218 and the other end carries a deflection mirror 258 opposite the projector 254. Thus a projection path 260 results which produces a projection display 249 on the steering wheel 210 and which swivels together with the steering wheel 210 about the axis 224.

The projection display or reproduction may take place on an incorporated translucent glass.

In this way the projection display 249 is always on the upper zenith 234, independently of the rotation and swiveling of the steering wheel 210 about the axes 214 and 224 (FIG. 8). The steering wheel 210 forms in this case altogether a screen for the projector 254 and is, for this purpose, e.g. optically equipped with a mirror surface or an opaque surface area proceeding in the circumferential direction, upon which the data is reflected or faded into on a viewing side of the steering wheel 210.

By virtue of the novel construction of the steering stand 200, the helmsman is virtually seated in the steering wheel 210 and passes his legs through the steering wheel in order to be able to actuate the pedals 248 and 250. The entire steering wheel 210 can be utilized as display across its circumference. All types of spokes as employed in conventional steering wheels and steering columns are thus dispensed with.

The size of the steering wheel 210 may by any whatever and is determined solely by the objective that a helmsman has to be at all times capable of actuating the same in a sitting position while stretching his legs through the steering wheel. This is achieved by the open support of the steering wheel 210 in the floor portion 222 of the steering stand. The swivelability of the steering wheel 210 about the axis 224 enables the helmsman to swivel the steering wheel 210 into an optimal actuating and reading position for him of the reflected-in data or the data indicated on the monitor 240.

The swivelability of the steering wheel 210 in the direction of the arrow 262 (FIG. 12) can be effected be means of a slide guideway in order to be able to move the steering wheel 210 in the forward and rearward direction. The respective angular position is preferably fixable with the aid of locking means. The swivel axis 224 is preferably mounted in the floor area, e.g. the deck 222 of a ship. The steering wheel 210 itself can more particularly be comprised of transparent glass-like material or of plastic.

Moreover, by preference within the upper region of the steering wheel, an additional display is provided, upon which further data can be indicated.

The FIG. 13 shows a further embodiment of a steering wheel 210, in which case two display areas 232 are provided, which may be projection displaye 249 or displays traveling along with the steering wheel 210. In this fashion, the steering wheel 210 is divided into several sections. Further sections of the steering wheel can be provided with bead-like-constructed handling aids of rubber or some other suitable material in order to enhance the grip.

Figure 14:
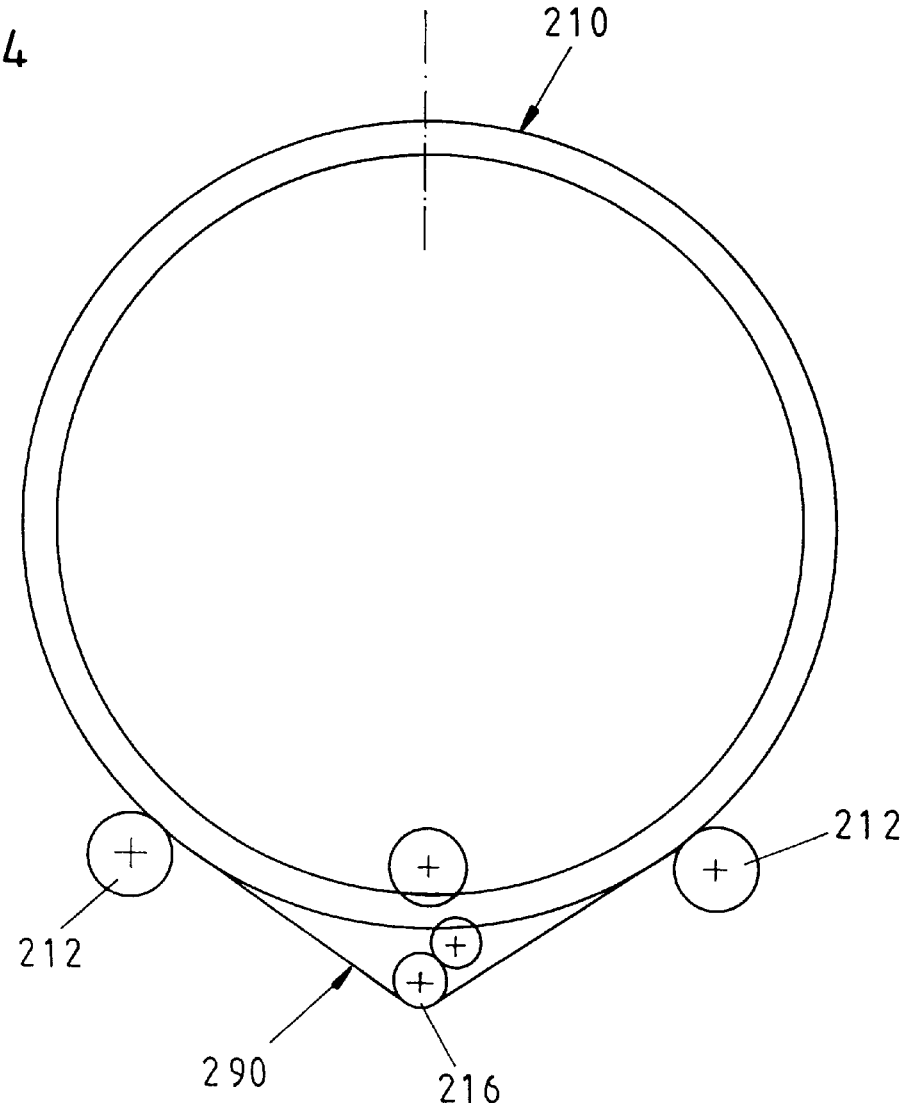
FIG. 14 shows a top view on to a steering wheel according to a further embodiment with a slip-through safety device when the steering wheel rotation is transmitted to the transmitting roller.

In order to ensure also in the event of wetness or of an oil contamination of the steering wheel 210 a perfect and precise transmission of the steering wheel rotation to the transmitting rollers 216 so as to avoid a slipping through, by means of a device 290 traveling along with the steering wheel 210, e.g. a silicon-coated steel cable or a knob tape with a rubberized back or toothing on the inner circle of the steering wheel, which operates a toothing on the transmitting roller 280, triggers the transmitting roller 216 doubly or also on its own (FIG. 14). This is effected by means of a deflection roller for the purpose of retaining the direction of rotation. In this case the internal toothing on the inside of the steering wheel 210 is the most space-saving alternative, no deterioration of the installation depth results either. The transmitting roller 216 is equipped with merely one gear wheel. Tensioning rollers and transmission rollers are dispensed with.

What is claimed is:

1. A ship comprising:

a hull (100) having an elevated steering stand (200), wherein the hull (100) is provided with several means for the leveling compensation of hull movements in the pitching direction, in the rolling direction, and in the vertical direction;

a first one of the means for the leveling compensation comprising trimming rudders (28) mounted on the underside of the hull and located on the bow side, the stern side or both the bow side and the stern side, each one of the trimming rudders (28) being swivelable relative to the hull (100) along a swivel line (30) extending at a predetermined angle to a longitudinal axis of the hull (100), wherein the swivel lines (30) of two oppositely located trimming rudders (28), one of which is mounted on the port side and the other on the starboard side, diverge in a forward travel direction of the ship;

each trimming rudder (28) mounted adjacent to and upstream of a breakaway of flow point (26, 32) on the underside of the hull (100);

the trimming rudders (28) steerably connected with the ship's rudder, the swivel angle of the trimming rudders (28) being adjustable relative to the hull (100) by means of pressing and pulling of the ship's rudder analogously to a control column of an airplane;

a second one of the means for the leveling compensation comprising a connecting turret (12) mounted on the hull (100) and configured to be pneumatically, hydraulically or mechanically moveable relative to the hull (100) in the pitching direction, in the rolling direction, and in the vertical direction, the connecting turret (12) comprising at least one lifting cylinder element for moving the connecting turret (12);

a third one of the means for leveling compensation comprising a hydraulically or mechanically moveable support provided at the steering stand (200) for connecting the steering stand (200) to the connecting turret (12), the moveable support configured to move the steering stand (200) relative to the connecting turret (12) and thus the hull (100) in the pitching direction, in the rolling direction, and in the vertical direction, wherein the moveable support comprises at least one lifting cylinder element for moving the steering stand (200).

2. A ship according to claim 1, comprising an electronic controller with level sensor for moving the connecting turret (12) in such a way that the steering stand (200) on the connecting turret (12) is leveled against hull motions caused by rough seas.

3. A ship according to claim 1, comprising longitudinally adjustable passages for persons mounted between the hull (100) and the connecting turret (12) and between the connecting turret (12) and the steering stand (200), wherein the steering stand (200) is constructed in the form of a cockpit.

4. A ship according to claim 1, wherein at least one predetermined section of a hull wall processes an S-configured cross-sectional profile.

5. A ship according to claim 1, wherein the hull (100), from the bow in the direction of the stern, widens in an arrow shape and, beginning at a midship deck area (34) of the hull (100), tapers strongly only in the above-water portion of the hull.

6. A ship according to claim 1, comprising at least one bow thruster (20) respectively within the midship area and on the stern on the underside of the hull, wherein the bow thrusters (20) are additionally provided with retractable sword-type rudders (18).

7. A ship according to claim 1, wherein the steering stand (200) has a steering wheel (210) for the operation of the ship's rudder and guiding means (212, 218) configured to circumferentially support the steering wheel (210) so as to be rotatable about a center axis (214) of the steering wheel (210), the steering wheel (210) substantially being a circular hoop and the guiding means being rollers (212) disposed on both sides of the circumference of the steering wheel (210), wherein the guiding means has a frame (218) which is rotatably mounted in such a way that the guiding means and the steering wheel (210) are swivelable about a swivel axis (224), which is substantially aligned along a floor area (222) of the steering stand (200).

8. A ship according to claim 7, wherein the frame (218) is mounted laterally on two pivot points (220) on a floor (222) of the steering stand (200) and the swivel axis (224) extends substantially vertically to the center axis (214) of the steering wheel (210), wherein the steering wheel (210) has at least one display means (323, 249) mounted on the circumference of the steering wheel (210) so as to substantially follow movements of the steering wheel (210).

9. A ship according to claim 8, wherein the display means comprises a projector (254), a deflecting mirror (258), and a screen or a display (249), the screen (249) mounted on the circumference of the steering wheel (210) and the projector (254) mounted at a distance from the screen (249) on the guiding means (212, 218), wherein the deflecting mirror (258) is disposed between the projector (254) and the screen (249).

10. A ship according to claim 7, wherein, on a side of the steering wheel (210) facing away from an operator, a monitor (240) and pedals (248, 250) are positioned.

11. A ship according to claim 7, wherein the steering wheel (210) has a transmitting roller (216) for transmitting the steering wheel rotation to the ship's rudder and further has a slip-through preventing means (290) acting on the transmitting roller (216), the slip-through preventing means (290) traveling together with the steering wheel (210) and controlling the transmitting roller (216) doubly or alone.

12. Steering wheel for the ship according to claim 1, comprising circular hoops and guiding means in the form of rollers (212), wherein the rollers (212) are mounted on both sides of the circumference of the steering wheel (210) in such a way that the steering wheel (210) is circumferentially supported so as to be rotatable about its center axis (214), wherein the guiding means has a frame (218) which is rotatably mounted in such a way that the guiding means and the steering wheel (210) are swivelable about a swivel axis which is substantially aligned along a floor area (222) of the steering stand (200).

13. Steering wheel according to claim 12, wherein the frame (218) is laterally mounted on two pivot points (220) on a floor (222) of the steering stand (200) and the swivel axis (224) extends substantially vertically to the center axis (214) of the steering wheel (210), wherein the steering wheel (210) has at least one display or indicating means (232, 249) which is disposed on the circumference of the steering wheel (210) so as to essentially follow movements of the steering wheel (210).

14. Steering wheel according to claim 12, wherein the indicating means has a projector (254), a deflecting mirror (258), and a screen or display (249), the screen (249) mounted on the circumference of the steering wheel (210) and the projector (254) mounted spaced from the screen (249) on the guiding means (212, 218), wherein the deflecting mirror (258) is disposed between the projector (254) and the screen (249).

15. A ship according to claim 9, wherein the display extends over the entire circumference of the steering wheel (210).

16. A ship according to claim 11, wherein the slip-through preventing means (290) is a steel cable sheathed in a plastic material.

17. A ship according to claim 11, wherein the slip-through preventing means (290) is a knob-studded tape with a rubber back.

18. A ship according to claim 11, wherein the slip-through preventing means (290) is comprised of a toothing on the inner circle of the steering wheel (210) and a meshing toothing on the transmitting roller (216), so that the transmitting roller (216) is triggered doubly or on its own.

19. A ship according to claim 14, wherein the display extends over the entire circumference of the steering wheel (210).

* * * * *